US005906283A

United States Patent [19]

Kump et al.

[11] Patent Number: 5,906,283

[45] Date of Patent: May 25, 1999

[54] PRODUCT PUSHER

[75] Inventors: Daniel J. Kump, Gates Mills; Stephen D. Wamsley, Lakewood, both of Ohio

[73] Assignee: Fasteners For Retail, Inc., Cleveland, Ohio

[21] Appl. No.: 08/915,150

[22] Filed: Aug. 20, 1997

Related U.S. Application Data

[63] Continuation-in-part of application No. 08/740,441, Oct. 30, 1996, abandoned.

[51] Int. Cl.[6] ..... A47F 5/00

[52] U.S. Cl. ..... 211/54.1; 312/71

[58] Field of Search ..... 211/54.1, 51, 59.3; 312/61, 71, 50

[56] References Cited

U.S. PATENT DOCUMENTS

| | | | |
|---|---|---|---|
| 3,251,464 | 5/1966 | Hanson . | |
| 3,696,937 | 10/1972 | Braverman . | |
| 4,062,137 | 12/1977 | Herzog . | |
| 4,066,169 | 1/1978 | Hochman . | |
| 4,475,658 | 10/1984 | Roberts . | |
| 4,525,944 | 7/1985 | Fast . | |
| 4,588,093 | 5/1986 | Field | 211/51 |
| 4,694,595 | 9/1987 | Fast . | |
| 4,703,570 | 11/1987 | Fast . | |
| 4,715,135 | 12/1987 | Fast . | |
| 4,754,563 | 7/1988 | Fast . | |
| 4,821,894 | 4/1989 | Dechirot . | |
| 4,869,376 | 9/1989 | Valiulis et al. . | |
| 5,009,334 | 4/1991 | Bodkins . | |
| 5,040,316 | 8/1991 | Fast . | |
| 5,054,646 | 10/1991 | Hammerschlag et al. . | |
| 5,114,021 | 5/1992 | Fredrickson . | |
| 5,123,189 | 6/1992 | Fast et al. . | |
| 5,222,608 | 6/1993 | Eklof et al. . | |
| 5,439,120 | 8/1995 | Brozak . | |
| 5,641,077 | 6/1997 | Tufano et al. . | |

*Primary Examiner*—Robert W. Gibson, Jr.
*Attorney, Agent, or Firm*—Fay, Sharpe, Beall, Fagan, Minnich & McKee

[57] ABSTRACT

A one piece pusher urges merchandise items towards a front end of a pegboard mounted hook in a merchandise display system. The hook is used for slidably suspending associated merchandise items. The hook includes a back end which can be mounted in a pegboard and a front end having a generally upwardly turned tip for preventing the merchandise items from sliding off the hook. The pusher includes a mounting portion by which the pusher is mounted on the back end of the hook and an elongated portion extending forwardly from the mounting portion. The elongated portion includes a first aperture, a second aperture and a first slit extending between the first and second apertures. The first slit allows the elongated portion of the pusher to be mounted on the hook so that the first and second apertures surround the hook at spaced locations. The pusher further includes a front face of the elongated portion. The front face contacts a rearmost one of the merchandise items to urge it forwardly on the hook. Preferably, the pusher also includes a display portion extending from the front face of the elongated portion.

25 Claims, 6 Drawing Sheets

PRODUCT PUSHER

BACKGROUND OF THE INVENTION

This application is a continuation-in-part of U.S. patent application Ser. No. 08/740,441 which was filed on Oct. 30, 1996 and is now abandoned.

The present invention relates to merchandise display assemblies. More particularly, the instant invention relates to a one piece resilient product pusher for urging merchandise items towards the front end of a hook.

In the field of retail merchandising, increasing use has been made in recent years of hook and pegboard assemblies for the retail display of relatively small merchandise items. Such assemblies typically consist of an upright pegboard to which are attached a number of spaced merchandise hooks. Retail merchandise items are hung from the hooks, typically by way of a merchandise package having a hole punched near its top. The front package on each hook may be easily removed by the customer for examination or purchase whereupon the next merchandise item on the hook is visibly displayed.

The hook and pegboard assembly is one of several types of point of purchase merchandising fixtures that are commonly available to hold and display retail merchandise on a self-serve basis in retail stores. Other such fixtures include racks, bins and shelves for holding and displaying merchandise items. All of these point of purchase merchandise fixtures are designed to encourage and facilitate the selection of items by customers without assistance from sales personnel. The retail sales industry has increasingly relied on hook and pegboard assembly-type point of purchase merchandise fixtures in preference over the other types mentioned above.

First, the hook and pegboard assembly presents a neatly arrayed assortment of items. Like items may be grouped together on individual hooks such that only a single item of each type is displayed at a time. Second, the hooks maintain the merchandise items in an orderly display yet a customer may nevertheless easily remove an item for examination or purchase and just as easily replace the item without disturbing the display. Third, the hook and pegboard display assembly is particularly well adapted for deterring shoplifting by enclosing small retail items in bulky packages. This practice typically takes the form of packaging a small item on a relatively large sheet of cardboard and covering it with a vacuum-formed clear plastic shell thereby rendering the item bulky and difficult to conceal by a potential shoplifter. However, such packages are difficult to display in a pleasing manner in a bin or on a shelf. On the other hand, they can be conveniently displayed on a hook by punching a hole near the upper edge of the cardboard backing and hanging the package from a hook.

Hook and pegboard displays are also advantageous from the standpoint that the cardboard can be used as an advertising medium whereby printed advertisements can be placed on the front of the cardboard backing around the packaged items. Hanging the items from hooks enables all of the items to be displayed in an upright orientation and facing in the same direction, thus keeping the advertising messages on the cardboard backings properly positioned for easy reading by customers.

The hook and pegboard assembly is also useful for displaying goods enclosed in bags since the bags may be hung by a punched hole near its upper sealed margin. As with the packages described above, the bag itself may be used as an advertising medium as well as a merchandise container and may be readily displayed in a readable manner on the hook and pegboard assembly.

In addition to the foregoing, the hook and pegboard assembly is also preferred because it permits a larger product line to be displayed in a limited retail space than do the other types of point of purchase merchandise fixtures known in the art. Individual hooks may be arranged as close together on a pegboard as the sizes of the displayed packages will allow. This permits a relatively high density of different product items to be individually displayed. In addition, the particular arrangement of the hooks on the pegboard may be tailored to best display items of assorted sizes and shapes in an attractive manner. This flexibility permits a more efficient use of space than can be attained with racks, shelves or bins.

Despite the advantages mentioned above for hook and pegboard display assemblies, certain problems do exist for these types of point of purchase merchandise fixtures. First, the use of a large number of display hooks protruding towards the passageways and aisles of retail stores has resulted in a disconcertingly large number of personal accidents and injuries. The exposed hooks tend to snag clothing. More seriously, the exposed hooks have a tendency to injure people, especially children, who fall or are pushed onto a display.

A commercial problem with hook and pegboard merchandise displays is the decrease in sales due to decreasing visibility of remaining merchandise items after the front packages have been removed from a hook. When a large array of merchandise items is hung from a hook, the removal of several packages from the front end of a hook leaves the remaining packages near the back end of the hook and partially hidden from view. It is well recognized in the retailing industry that this has a direct negative effect on sales of the remaining items. It also gives an unkempt appearance to the overall display. Therefore, the sales of all items in the display can be negatively affected somewhat. Decreased visibility is particularly a problem with respect to hooks positioned either higher than or lower than the average eye level of shoppers. In these cases, the remaining packages at the back of the hook become almost fully obscured and the problem becomes similar to the well known problem in the retail industry of selling goods from a floor level shelf.

In order to overcome such problems, it is known to provide a product pusher in the form of a conical compression spring, mounted on the hook, and located between the last item on the hook and the pegboard. The spring is meant to urge the merchandise forwardly on the hook to fully display the merchandise at the front end of the hook until the last item is removed from the hook. Such a spring is illustrated in U.S. Pat. No. 4,475,658. However, the use of the conventional types of springs, whether they be coil springs, leaf springs or conical compression springs, is disadvantageous. First, metal springs are fairly expensive and will cost the retailer a sizeable sum of money to provide each of the retailer's hooks with such a spring. Second, even if the spring is made of a plastic or other resilient material, the spring is relatively difficult and expensive to manufacture. Therefore, equipping a store with such springs will cost the retailer a significant sum of money.

Another known type of pusher product involves the use of an inventory control device formed from either a single piece of wire or a plastic extrusion and including an eye, a bridge and an open hook. Such a device is illustrated in U.S. Pat. No. 4,869,376. The device is installed by slipping the eye onto one arm of a multi-arm display hook and hooking the open hook of the device around the other arm. However, in order to urge the merchandise items towards the front end of a hook, the merchant has to manually push the device forward on the pair of adjacent hooks. Thus the device is not automatic as the merchant has to periodically push the control device, and the merchandise items forward manually. Indeed, this type of device does not appear to materially assist the merchant because he still has to manually push the merchandise items forward.

Another type of known pusher device for urging merchandise items towards the front end of a hook is illustrated in U.S. Pat. No. 4,821,894. This device includes a back piece secured on a hook, a front piece secured on the hook and a sliding thrust plate which is urged forwardly on the hook by a spring having one end mounted to the thrust piece, having a central portion wound around the front piece and having a rear portion secured on the rear piece. It is evident that this type of product pusher is fairly expensive to manufacture and install. In addition, this type of design necessitates the merchant having to remove the hook, and the product hung on it, in order to install the product pusher. A similar type of product pusher is disclosed in U.S. Pat. No. 5,114,021.

Finally, it is known to have a gravity fed merchandising system in which the hooks that extend from a support member angle downwardly instead of upwardly. However, this type of system is disadvantageous from the standpoint that a large front plate needs to be secured on the hook in order to insure that the merchandise items do not fall off the hook. Such a design is illustrated in U.S. Pat. No. 5,439,120.

Accordingly, it has been considered desirable to develop a new and improved product pusher for a merchandise display assembly which would overcome the foregoing difficulties and others while providing better and more advantageous overall results.

BRIEF SUMMARY OF THE INVENTION

In accordance with the present invention, a new and improved merchandise display assembly is provided.

More particularly in accordance with this aspect of the invention, the display assembly comprises a support member and a hook projecting from the support member for slidably suspending associated merchandise items, the hook including a back end which is mounted in the support member and a front end having a retainer member for preventing the merchandise items from sliding off the hook. A resilient one piece pusher is provided for urging the merchandise items towards the hook front end. The pusher comprises a mounting portion by which the pusher is mounted on the back end of the hook and an elongated portion extending from the mounting portion. The elongated portion includes a first aperture, a second aperture spaced from the first aperture and a first slit extending from the first aperture to the second aperture. The first slit allows the elongated portion to be mounted on the hook so that the first and second apertures surround the hook at spaced locations. A front face of the elongated portion contacts a rearmost one of the associated merchandise items.

Preferably, the pusher further comprises a display portion for displaying merchandising information with the display portion being connected to the elongated portion. The display portion preferably extends from the front face of the pusher elongated portion. Alternatively, the pusher can further comprise a frame portion connected to the elongated portion and wherein the display portion is connected to the frame portion. The frame portion can be disposed in parallel relationship to the elongated portion. If desired, the elongated portion can further include a third aperture, a fourth aperture and a second slit extending between the third and fourth apertures, the third and fourth apertures and second slit being spaced from the first and second apertures and the first slit along the length of the elongated portion. The second slit allows the elongated portion to be mounted on the hook so that the third and fourth apertures surround the hook at spaced locations. The mounting portion of the pusher can comprise a pair of spaced apertures and a reinforcing rib which is positioned between the pair of spaced apertures. Alternatively, the mounting portion can comprise a third aperture extending through the elongated portion, a fourth aperture extending through the elongated portion and a second slit extending between the third and fourth apertures with the third and fourth apertures and the second slit being spaced from the first and second apertures in the first slit along the length of the elongated portion. The second slit allows the elongated portion to be mounted on the hook so that the third and fourth apertures surround the hook at spaced locations. If desired, the elongated portion further comprises a third aperture and a second slit extending from the third aperture to the front face of the elongated portion to allow the front face to be mounted on the hook until the third aperture surrounds the hook.

One advantage of the present invention is the provision of a new and improved merchandise display assembly including a product pusher.

Another advantage of the present invention is the provision of a resilient one piece product pusher for urging packaged merchandise items towards the front end of a hook mounted on a support structure, such as a pegboard.

Still another advantage of the present invention is the provision of a product pusher made from a thin sheet of a conventional thermoplastic material so as to be inherently resilient.

Yet another advantage of the present invention is the provision of a product pusher which installs quickly without the need to remove either the packaged product from the hook or the hook from the pegboard, or other support member, to which the hook is secured.

A further advantage of the present invention is the provision of a product pusher which is integrated with a header that holds a UPC (uniform price code) label at the front end of a hook.

A still further advantage of the present invention is the provision of a product pusher which includes at least two spaced apertures connected by a slit wherein the apertures accommodate a hook onto which the pusher can be secured via the slit. The product pusher assumes a serpentine configuration behind the rearmost product on the hook to urge the products forwardly.

A yet further advantage of the present invention is the provision of a product pusher which includes a pusher section and a frame section preferably surrounding the pusher section on three sides. The pusher section can be separated from the frame section by cut lines or by perforations. In the latter case, the pusher section would remain integral with the frame section until the pusher is torn away from the frame section along the perforations. The product pusher also includes a mounting section for mounting the product pusher on a hook.

An additional advantage of the present invention is the provision of resilient one piece product pushers which can be manufactured from an elongated sheet of material, die cut to form individual product pushers and which are resilient enough to be bent into the necessary shape to serve their function as product pushers.

Still other benefits and advantages of the present invention will become apparent to those of average skill in the art upon a reading and understanding of the following detailed specification.

BRIEF DESCRIPTION OF THE DRAWINGS

The invention may take physical form in certain parts and arrangements of parts, several embodiments of which will be described in detail in this specification and illustrated in the accompanying drawings which form a part hereof and wherein.

DETAILED DESCRIPTION OF THE PREFERRED EMBODIMENTS

Figure 1:
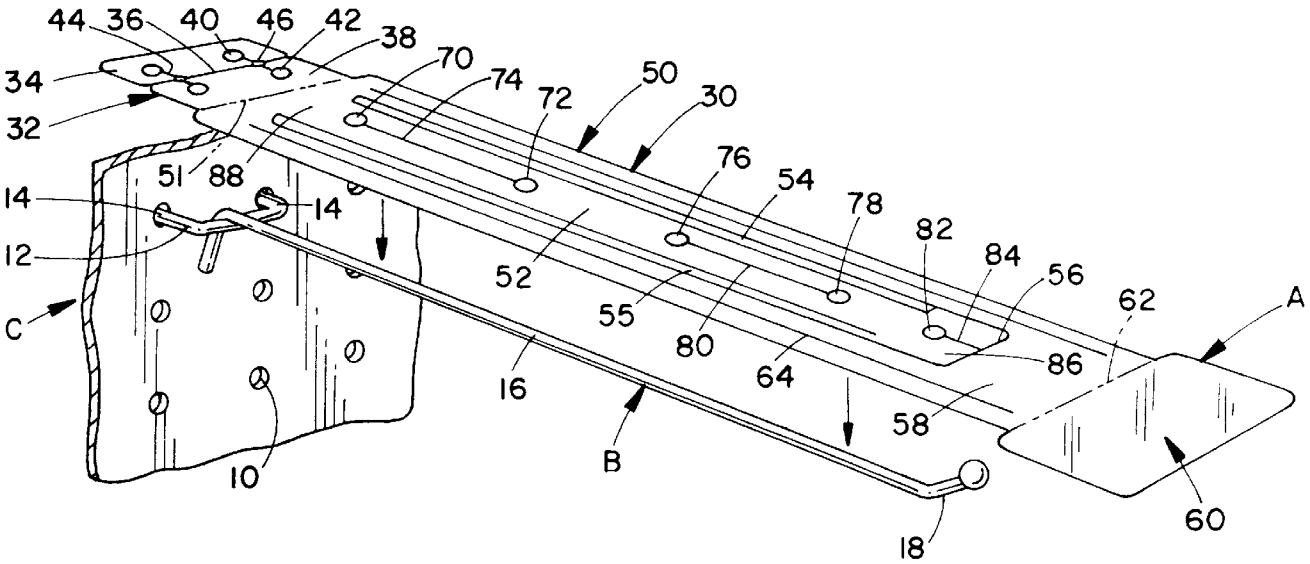
FIG. 1 is an exploded perspective view of a merchandise display system according to a first embodiment of the present invention including a product pusher illustrated in an elongated planar condition as it is manufactured from a sheet of material and before it is installed on a merchandise display hook.

Referring now to the drawings, wherein the showings are for purposes of illustrating several preferred embodiments of the invention only and not for purposes of limiting same, FIG. 1 shows a merchandise display assembly including a product pusher A located above a hook B wherein the hook is secured to a pegboard C. While a particular type of hook B is illustrated in FIGS. 1–5 and this hook is shown as being secured to a pegboard C, it should be appreciated by those of average skill in the art that there are many varieties of known hooks other than the hook B and that there are also many varieties of support structures other than the pegboard C to which such conventional merchandising support hooks can be secured.

The pegboard C includes a series of spaced apertures 10. The hook B includes a securing bracket 12 having a pair of spaced arms 14 that extend into the apertures 10. The hook B also includes a support bar 16 mounted on and secured to the securing bracket 12. The support bar has an elongated portion which terminates in an upturned tip 18. An enlarged ball is usually located at the apex of the tip to prevent injuries that could occur if a pointed tip were used.

The product pusher A includes an elongated blank of thin material 30 having a mounting portion 32 at a rear end thereof. The mounting portion includes a first section 34, a first fold line 36 and a second section 38. A first aperture 40 is located in the first section 34 and a second aperture 42 is located in the second section 38. A slit 44 extends between the first and second apertures. There is also a diamond-shaped opening 46 which is located at the fold line 36. It should be evident from FIG. 1 that two such sets of first and second apertures 40, 42 and slits 44 are provided in a spaced manner on the mounting portion 32. A central portion 50 of the blank 30 is separated from the mounting portion 32 by a second fold line 51.

The central portion 50 comprises a pusher member 52 which is outlined by a pair of slots 54 and 55 and a cut line 56 from a frame member 58 of the central portion 50. A display portion 60 is separated by a third fold line 62 from the central portion 50. Extending longitudinally along the frame 58 are a pair of spaced stiffening ribs 64.

Located in the pusher member 52 is a first aperture 70 and, spaced therefrom, a second aperture 72. A first slit 74 extends between the first and second apertures. Also located in the pusher member 52, in a spaced manner from the second aperture 72, is a third aperture 76 and a fourth aperture 78. Extending between these two apertures is a second slit 80. Further located in the pusher member 52, in a manner spaced from the other apertures, is a fifth aperture 82 and a third slit 84 which extends to a front end 86 of the pusher member 52. A rear end 88 of the pusher member is integral with the frame member 58 of the central portion 50.

Figure 2:
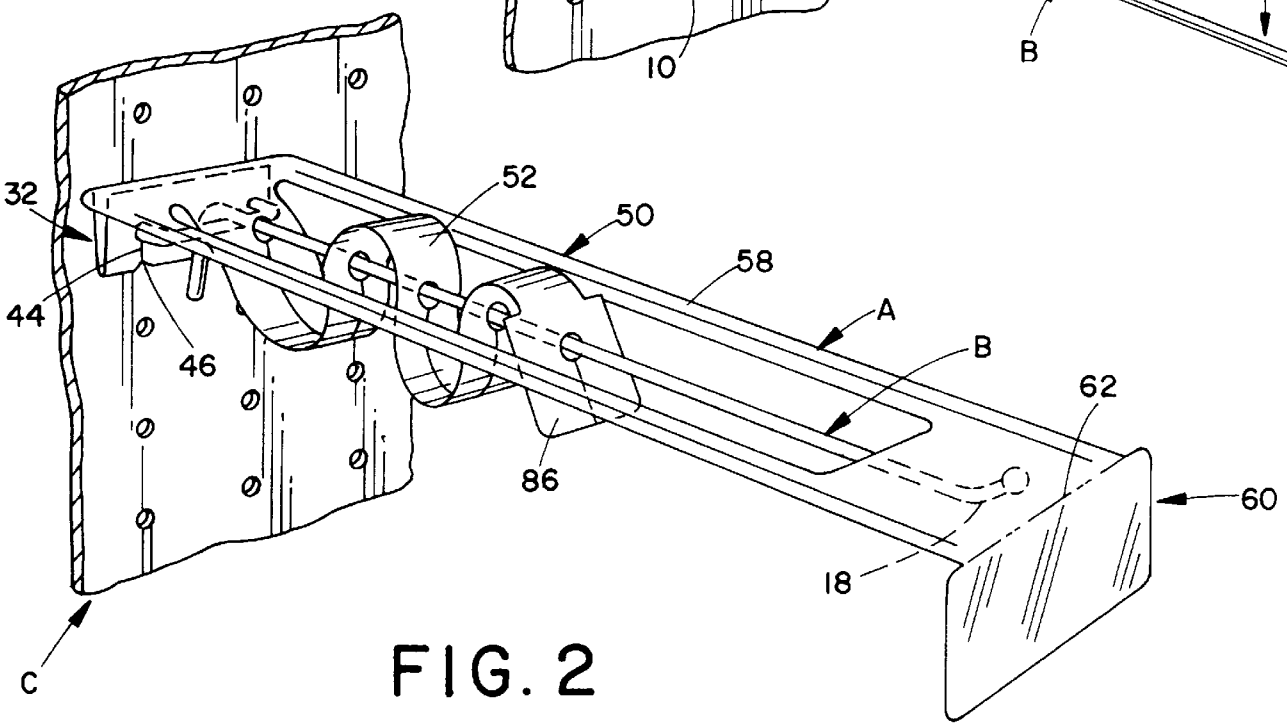
FIG. 2 is a perspective view of the merchandise display assembly of FIG. 1 with the product pusher in an installed condition on the merchandise display hook.

With reference now to FIG. 2, the mounting portion 32 of the pusher A can be folded up such that the entire mounting portion 32 is bent around fold line 51 by 90° and the first section 34 is bent around fold line 36 by 180° so as to underlie the central portion 50. Then the diamond-shaped opening 46 and the slits 44 are used to guide the mounting portion 32 onto the pair of spaced arms 14 of the hook B so that the pairs of apertures 40 and 42 in the mounting portion 32 surround the respective arms 14 of the securing bracket 12. This design is advantageous from the standpoint that the hook B need not be disassembled from the pegboard C in order to secure the merchandise display hook on the pegboard.

The pusher member 52 can also be inserted on the hook B, more specifically on the support bar 16 thereof, without having to remove the hook from the pegboard C. To this end, the first, second and third slits 74, 80 and 84 allow the pusher member 52 to be pushed onto the support bar 16 as far as the respective first, second, third, fourth and fifth apertures 70, 72, 76, 78 and 82 allow. Because of the resilient nature of the blank 30, the pusher member 52 thereof can be folded up in an accordion-like manner as is illustrated in FIG. 2. It is evident that the pusher section 52 can be separated from the surrounding frame member 58 along the slots 54 and 55 and the cut line 56. While circular apertures are illustrated as extending through the pusher member, it should be appreciated that other types of apertures could also be used.

Figure 3:
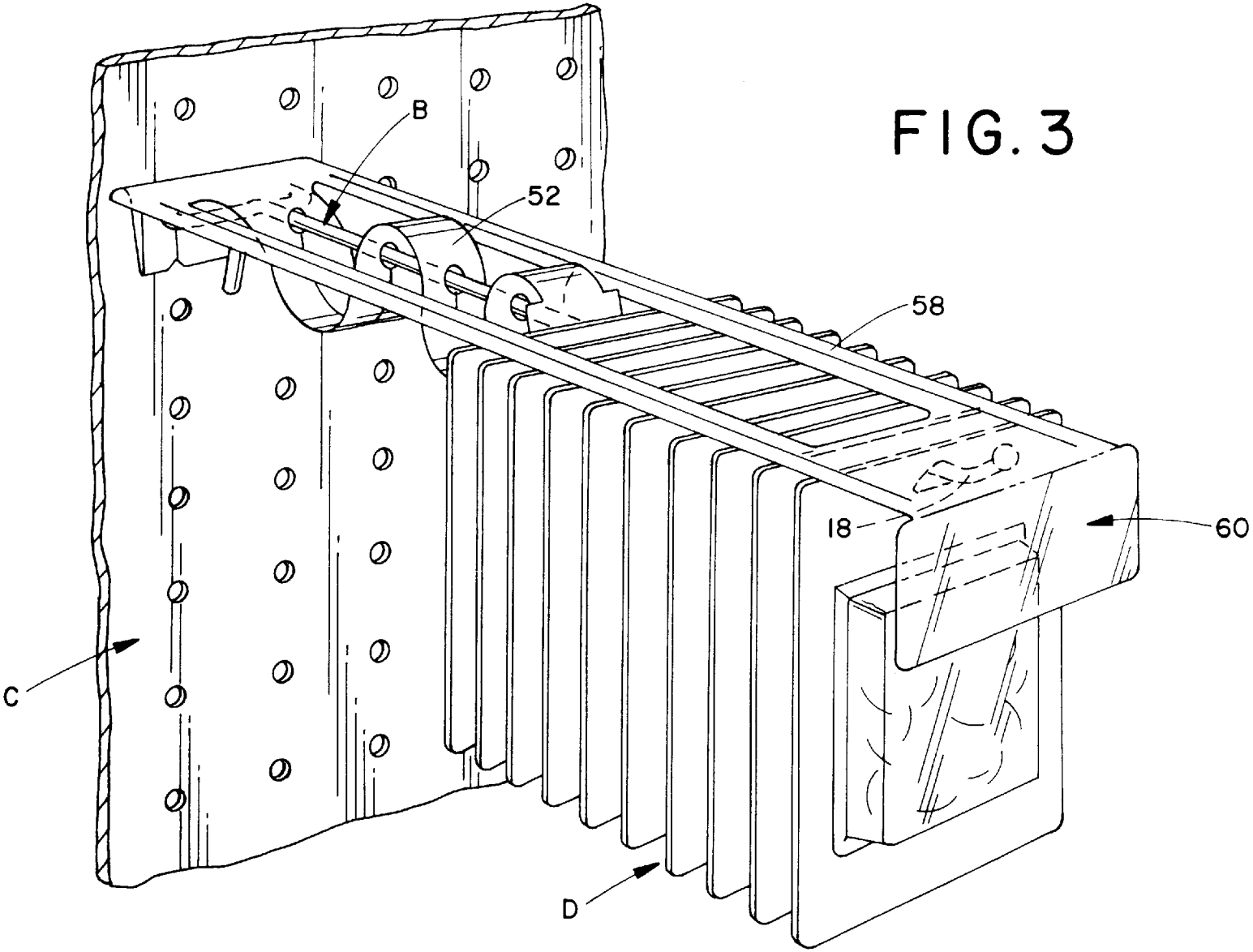
FIG. 3 is a perspective view of the merchandise display assembly of FIG. 2 shown as holding a plurality of packages of merchandise.

With reference now to FIG. 3, a plurality of packages D can be mounted on the hook B with the pusher 52 urging the packages D towards the tip 18 of the hook. The frame member 58 allows the pusher A to support the display portion 60 on which a UPC label can be supported along with other information. The frame member 58 extends forwardly past the pusher member 52 and the hook tip 18. In order to remove any of the packages D, the frame member 58 is merely pivoted upwardly in relation to the hook B and the front package D is removed from the hook. Once this occurs, the resilient nature of the pusher member 52 will urge the remaining packages D forwardly towards the tip 18 of the hook B. At the same time, the frame member 58 will descend because of gravity until an underside of the frame member contacts the ball on the end of the tip 18 of the hook B. The resilient nature of the material from which the pusher member 52 is manufactured is such as to urge the packages D forwardly on the hook B only to the extent that the forward package stops at the front end of the support bar where the tip 18 begins. In other words, the packages D do not ride up the upturned tip 18 and fall off the front of the hook B.

The pusher A can be made of any suitable type of planar thermoplastic material. One preferred type of material is a conventional 15 mil clear PETG thermoplastic. Naturally, other types of known thermoplastic materials could also be employed to manufacture the pusher A. One typical length of hook with which such a pusher can be used is, e. g. a 12" peg hook for which the pusher section 52 can have a 10" spring length. In the embodiment illustrated, the label area 60 can be of a conventional size such as, e.g. 1-½" high by 2-½" wide.

Figure 4:
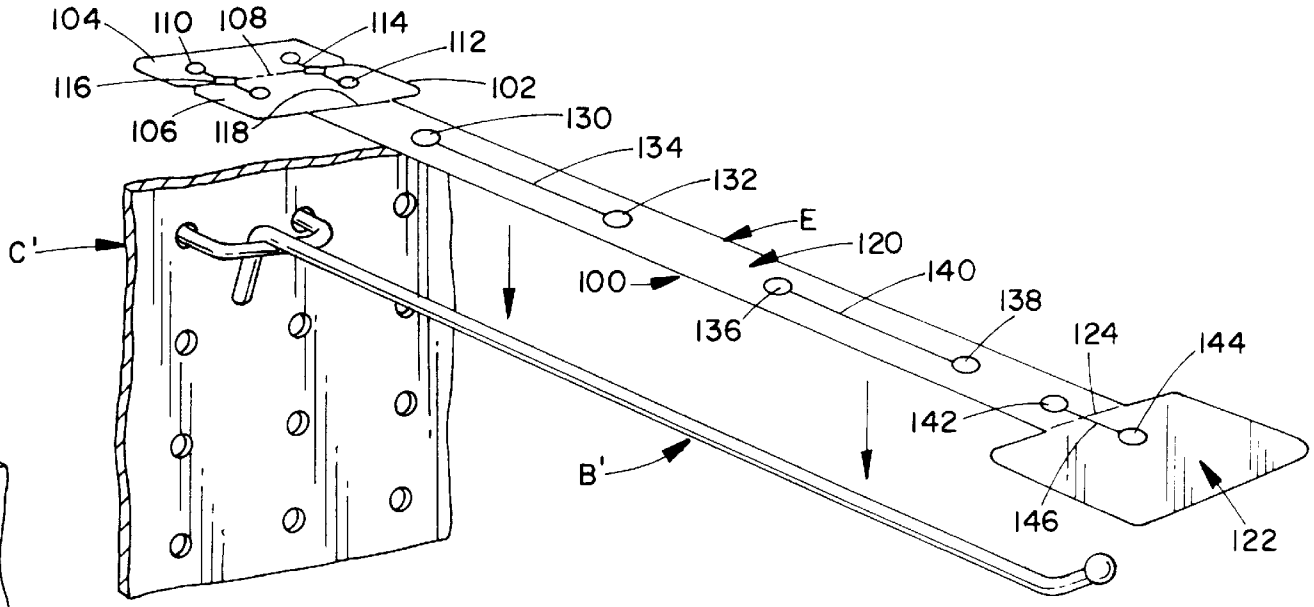
FIG. 4 is an exploded perspective view of a merchandise display assembly according to a second embodiment of the present invention with a planar one piece product pusher shown before it is bent into shape and installed on a merchandise display hook.

With reference now to FIG. 4, another type of product pusher E is there illustrated. For ease of understanding and appreciation of this embodiment, like components are identified by like numerals with a primed (') suffix and new components are identified by new numerals.

In this embodiment, the pusher comprises a blank 100 made from a suitable resilient thermoplastic material. The blank includes a mounting portion 102 having a first section 104, a second section 106 and a first fold line 108 that separates these two sections. Located on the first section is a first aperture 110 and located on the second section 106 is a second aperture 112. Extending between these two apertures is a slit 114 in which is located a diamond-shaped opening 116. A pair of such apertures and slits is located on the mounting portion.

Extending forwardly of the mounting portion 102, and separated therefrom by a second fold line 118, is a pusher portion 120. At the forward end of the pusher portion is a display portion 122 that is separated from the pusher portion by a third fold line 124.

Located in the pusher portion 120 is a first aperture 130 and, spaced therefrom, a second aperture 132. Extending between these two apertures is a first slit 134. Spaced from the second aperture 132 is a third aperture 136 and a fourth aperture 138. Extending between the latter two apertures is a second slit 140. Spaced from the fourth aperture 138 is a fifth aperture 142 located on the pusher portion. A sixth aperture 144 is located on the display portion 122. Extending between the fifth and sixth apertures 142 and 144 is a third slit 146 which crosses the fold line 124.

With continued reference to FIG. 4, the mounting portion 102 is folded up in relation to the pusher portion 120 such that the second section 106 is bent by 90° counterclockwise in relation to the pusher portion and the first section 104 is bent by 180° around fold line 108 so as to lie parallel to the second section 106. Then the slits and diamond-shaped openings 114 and 116 are employed when pushing the mounting portion onto a pair of spaced arms 14' of a hook B' until the respective apertures 110 and 112 enclose the arms 14', as is evident from FIG. 5. The first, second and third slits 134, 140 and 146 are then employed to push the pusher portion and the display portion 120 and 122 onto a support bar 16' of the hook B' until the respective apertures 130, 132, 136, 138, 142 and 144 enclose respective spaced portions of the support bar. Thus the pusher E assumes a serpentine form on the hook B'. In this embodiment, the front face of the pusher portion performs both a pushing function and a display function as it holds a standard UPC label above the last product which is hung from, and urged forwardly on, the display hook B'.

Figure 6:
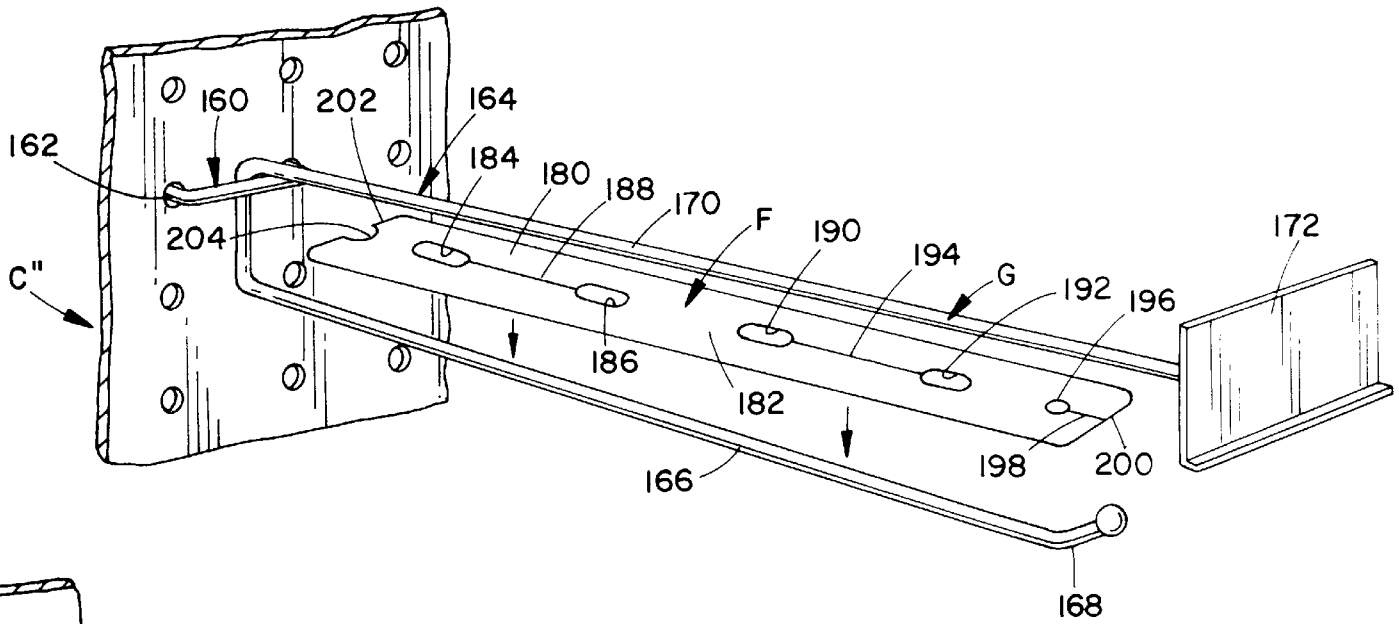
FIG. 6 is an exploded perspective view of a merchandise display assembly according to a third embodiment of the present invention with a planar product pusher shown before it is installed on a merchandise display hook.

With reference now to FIG. 6, a third type of pusher F is there illustrated. For ease of understanding and appreciation of this embodiment of the invention, like components are identified by like numerals with a double primed (") suffix and new components are identified by new numerals.

This pusher F is used on a second type of display hook G comprising a securing bracket 160 having a pair of spaced arms 162 as well as a U-shaped support section 164. The support section includes a lower arm 166 on a forward end of which there is provided an upwardly extending tip 168. An upper arm 170 includes a forward end on which there is located a display tag 172.

The pusher F comprises a blank 180 having a pusher section 182 in which there is located a first elongated aperture 184, a second elongated aperture 186 which is spaced therefrom and a first slit 188 which communicates the two apertures. Spaced from the second aperture 186 is a third aperture 190 as well as a fourth aperture 192. Extending between the latter two apertures is a second slit 194. Located near a front end of the pusher 182 is a fifth aperture 196 which communicates, via a third slit 198, with a front end 200 of the pusher 182. Located on a rear end 202 of the pusher is a half moon shaped slot 204.

Figure 7:
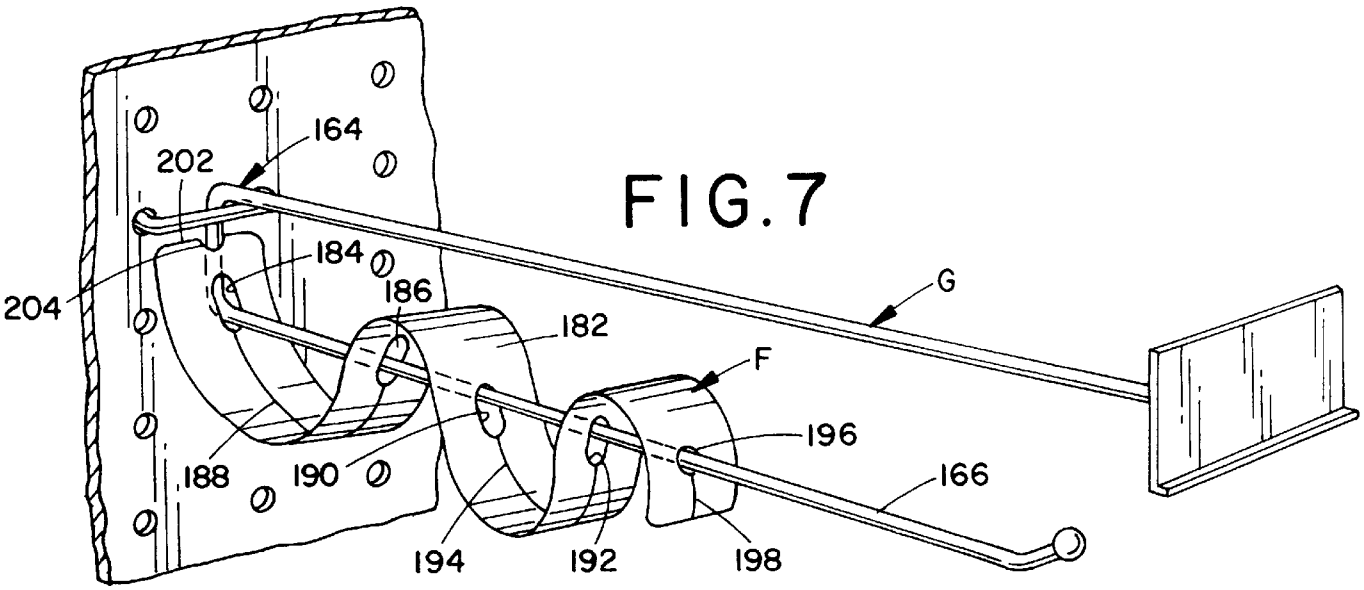
FIG. 7 is a perspective view of the merchandise display assembly of FIG. 6 after the product pusher is installed on the merchandise display hook.

With reference now to FIG. 7, the three slits 188, 194 and 198 allow the pusher 182 to be inserted onto the lower arm 166 of the hook G until the respective apertures 184, 186, 190, 192 and 196 enclose respective portions of the lower arm. The half moon shaped slot 204 on the rear end 202 of the pusher is advantageous to allow the pusher rear end to accommodate the rear portion of the U-shaped support section 164. The use of elongated apertures 184, 186, 190 and 192 for the pusher F is advantageous from the standpoint of allowing the pusher to more easily slide back and forth along the lower arm 166 of the hook G.

Figure 8:
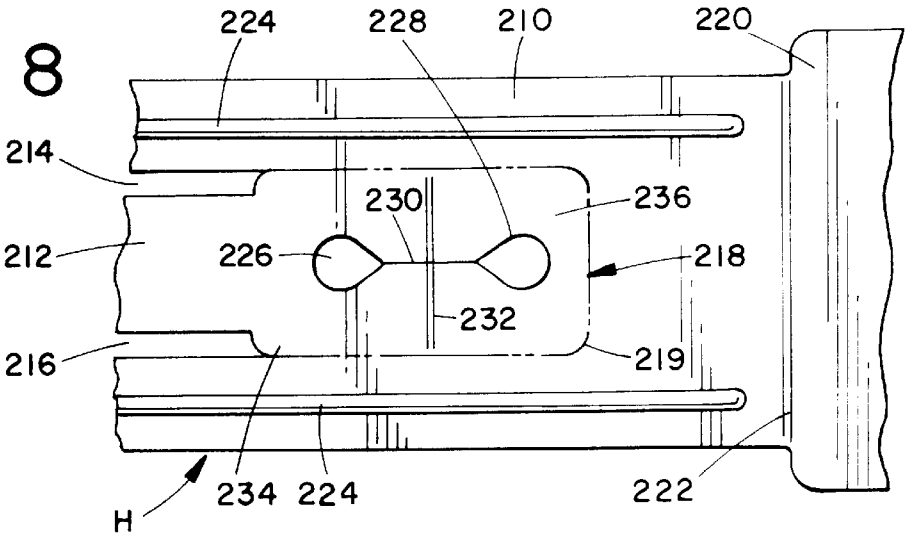
FIG. 8 is a top plan view of a front portion of a product pusher according to a fourth embodiment of the present invention.

With reference now to FIG. 8, a pusher H includes a central portion 210 comprising a pusher member 212 which is outlined by a pair of slots 214 and 216 and a tear line 218. Unlike the embodiment illustrated in, e.g., FIG. 1, the embodiment in FIG. 8 employs perforations 219 which define the tear line 218. Therefore, in the embodiment of FIG. 8, the product pusher 212 is only separated from the central panel 210 when so desired. Prior to such separation, the product pusher is integral with the central panel. A display portion 220 is separated by a fold line 222 from the central portion 210. Extending longitudinally along the central portion 210 are a pair of spaced stiffening ribs 224.

Located in the pusher member 212 is a first aperture 226 and, spaced therefrom, a second aperture 228. Extending between the two apertures is a slit 230. A fold line 232 is bisected by the slit 230. In this embodiment, the apertures 226 and 228 are tear drop shaped. The fold line 232 forms a first panel section 234 and a second panel section 236 in the pusher member 212. If desired, the second panel section 236 may be folded in relation to the first panel section 234 when inserting the pusher member on a hook.

Figure 9A:
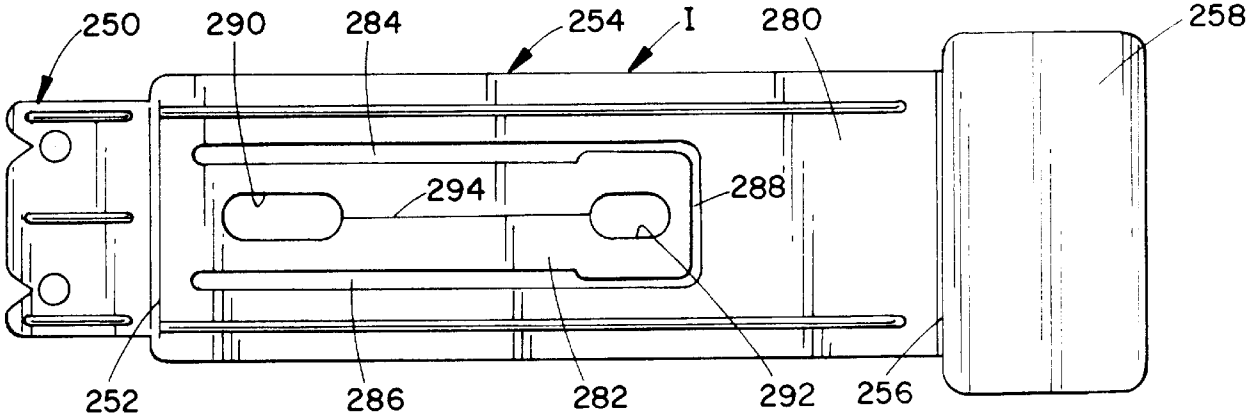
FIG. 9A is a top plan view of a product pusher according to a fifth embodiment of the present invention.
Figure 9C:
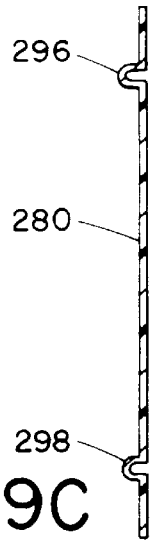
FIG. 9C is a cross-sectional view through the product pusher of FIG. 9B along line 9C—9C; and, FIG. 10 is a perspective view of a product pusher according to a sixth embodiment of the present invention after the product pusher is installed on a merchandise display hook.
Figure 9B:
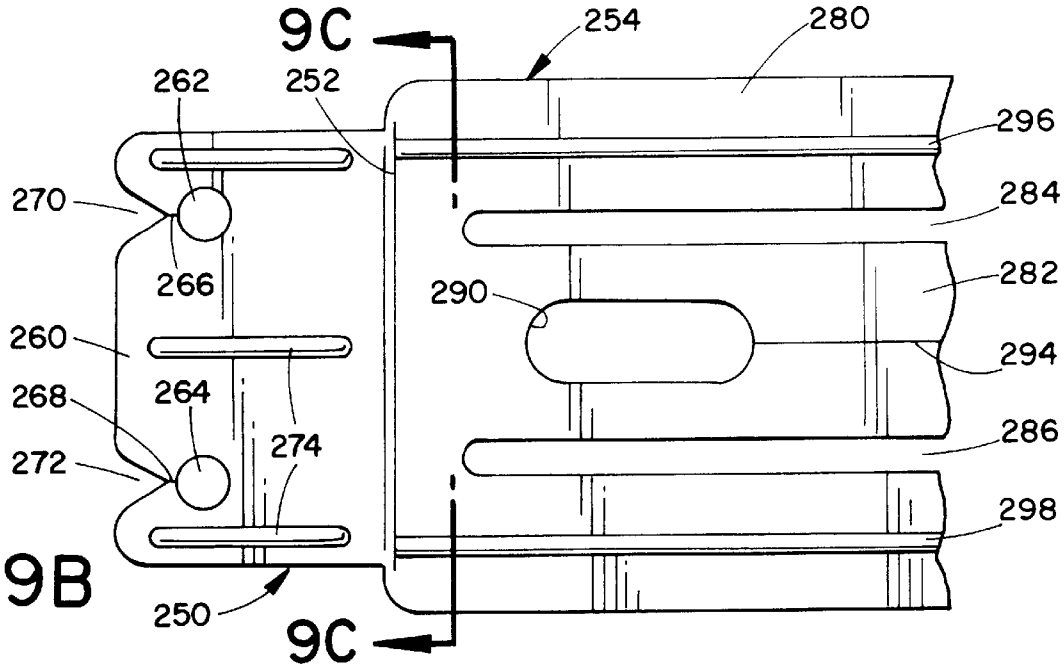
FIG. 9B is an enlarged top plan view of a rear portion of the product pusher of FIG. 9A.

With reference now to FIG. 9A, a fifth type of product pusher I is there illustrated. This product pusher comprises a mounting portion 250 which is separated by a first fold line 252 from a central portion 254. The central portion is separated by a second fold line 256 from a display portion 258. With reference now also to FIG. 9B, the mounting portion 250 includes a first panel 260 in which are provided a pair of spaced apertures 262 and 264. The apertures communicate via respective slits 266 and 268 with cutout portions 270 and 272. Extending longitudinally along the first panel 260 are a plurality of stiffening ribs 274. It is apparent that the stiffening ribs are longitudinally disposed along the panel 260 and are equidistantly located along the width of the panel 260 so that a central one of the stiffening ribs is located between the pair of apertures 262 and 264.

The central portion 254 comprises a second panel 280 including a pusher member 282 which is outlined by a pair of slots 284 and 286 as well as a cut line 288 as is illustrated in FIG. 9A. Defined in the pusher member 282 is a first aperture 290 and, spaced therefrom, a second aperture 292. Connecting the apertures is a slit 294. With reference now to FIG. 9C, a pair of spaced reinforcing ribs 296 and 298 are defined in the central panel 280. It is evident from the cross-sectional view of FIG. 9C that the pusher I is made from a suitable thermoplastic material.

Figure 5:
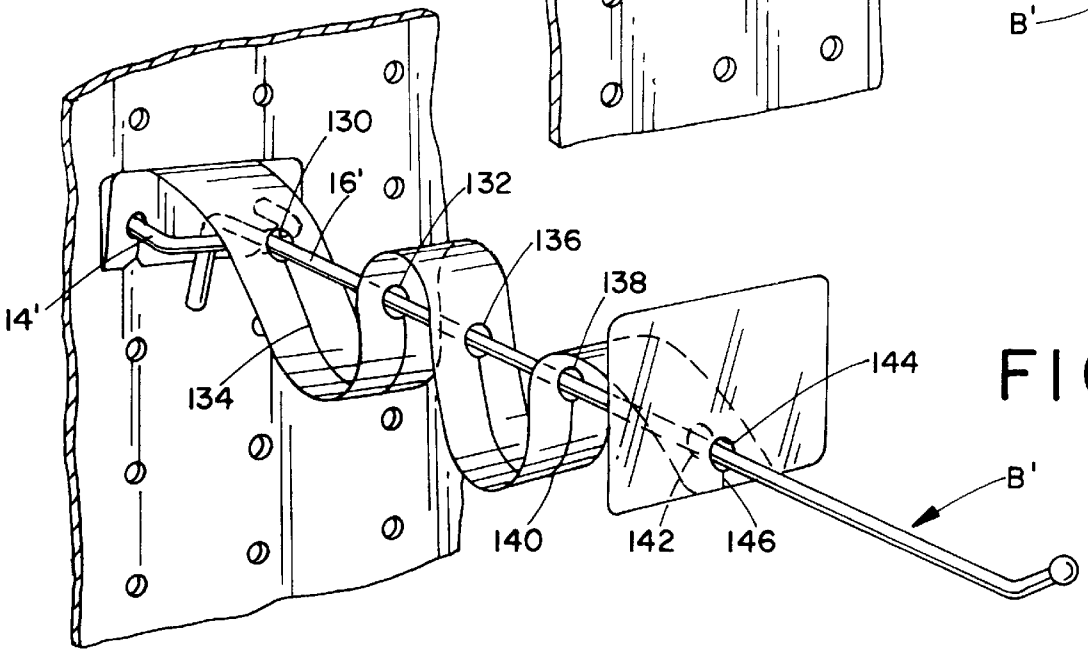
FIG. 5 is a perspective view of the merchandise display assembly of FIG. 4 after the product pusher is installed onto the merchandise display hook.

It is also evident that the apertures 290 and 292 are oblong in shape so as to accommodate a larger range of movement of the pusher member 282 on a hook than do the circular apertures illustrated in, e.g., FIGS. 2 and 5 or the teardrop shaped apertures illustrated in FIG. 8.

Figure 10:
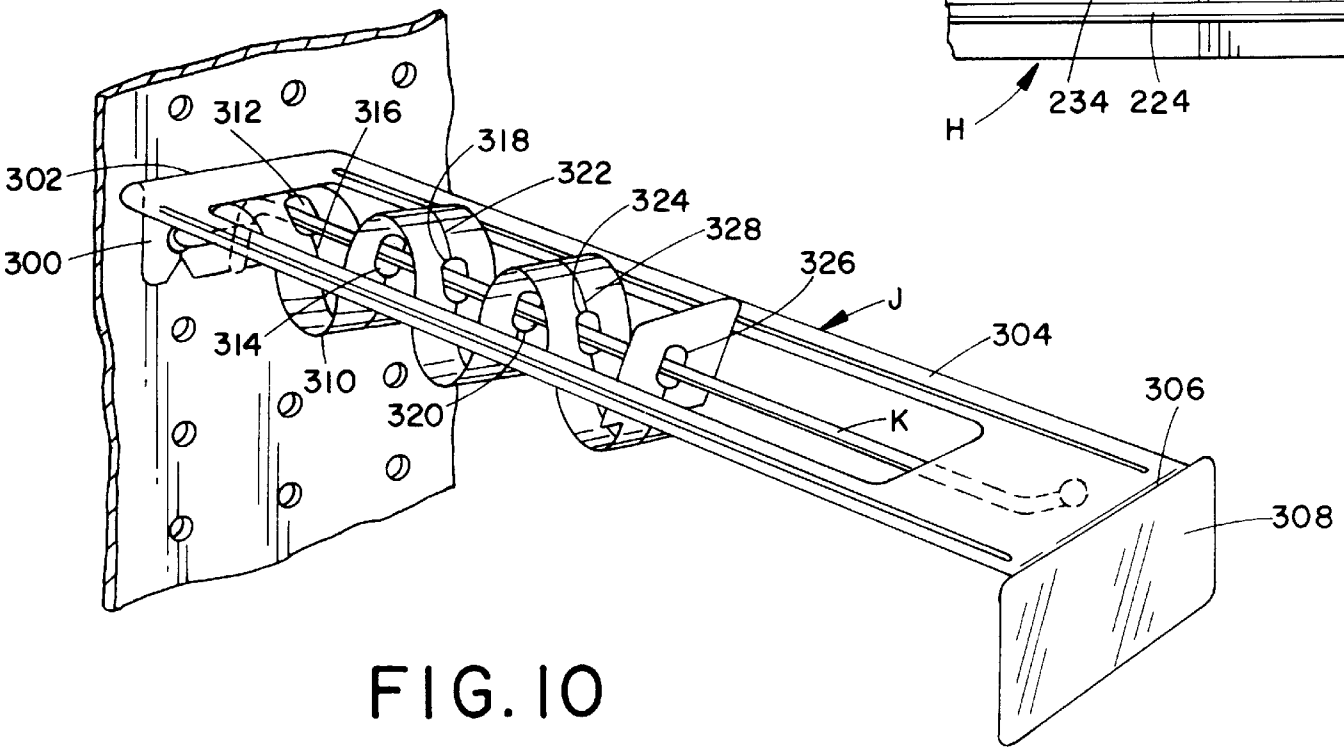

With reference now to FIG. 10, a pusher J according to a sixth embodiment of the present invention, comprises a mounting portion 300 which is separated by a first fold line 302 from a central panel 304. The central panel is, in turn, separated along a second fold line 306 from a display panel 308. The display panel protrudes in front of a hook K. Disposed in the central panel 304 is a pusher member 310. Defined thereon is a first pair of apertures 312 and 314 connected by a first slit 316, a second pair of apertures 318 and 320 connected by a second slit 322 and a third pair of apertures 324 and 326 connected by a third slit 328. It is evident that the three sets of spaced apertures allow the pusher member 310 to be mounted in a serpentine fashion on the hook K so as to urge product forwardly thereon.

It is apparent from FIG. 10 that the apertures 314, 318, 320, 324 and 326 are each oblong in shape so as to allow a large range of movement for the pusher member 310. When it is desired to mount the pusher member 310 on the hook K, the pusher member is separated along slits 316, 322 and 328 until the apertures 312, 314, 318, 320, 324 and 326 accommodate the hook. It is particularly noted that no fold lines are formed in the pusher member. Such fold lines would be disadvantageous from the standpoint that they would stress the thermoplastic material of the pusher member past its inherent resiliency so that the polymer chains of the material are disrupted, causing permanent crease lines in the pusher member. Such crease lines would adversely affect the desired pushing function of the pusher member. Such pushing function results from the natural resiliency of the thermoplastic material from which the pusher member 310 is made. However, once there are crease lines or fold lines in the pusher, it is no longer capable of urging products forward on the hook with the same efficiency as if there were no such fold lines in the pusher member.

The invention has been described with reference to several embodiments. Obviously, modifications and alterations will occur to others upon a reading and understanding of this specification. It is intended to include all such modifications and alterations insofar as they come within the scope of the appended claims and the equivalents thereof.

We claim:

1. A merchandise display assembly comprising:

a support member;

a hook projecting from the support member for slidably suspending associated merchandise items, said hook including a back end which is mounted in said support member and a front end having a retainer member for preventing the merchandise items from sliding off said hook; and, a resilient one piece pusher for urging the merchandise items toward said hook front end, said pusher comprising:

a mounting portion by which said pusher is mounted on said back end of said hook, an elongated portion extending from said mounting portion, said elongated portion including a first aperture, a second aperture, spaced from said first aperture, and a first slit extending from said first aperture to said second aperture, said first slit allowing said elongated portion to be mounted on said hook so that said first and second apertures surround the hook at spaced locations, a front face of said elongated portion, said front face contacting a rearmost one of the associated merchandise items, and a display portion for displaying merchandising information, said display portion being visible when associated merchandise items are mounted on said hook, said display portion being connected to said elongated portion.

2. The display assembly of claim 1 wherein said display portion extends from said front face of said elongated portion.

3. The display assembly of claim 1 wherein said pusher further comprises a frame portion connected to said elongated portion, and wherein said display portion is connected to said frame portion.

4. The display assembly of claim 3 wherein said frame portion is disposed in parallel relationship to said elongated portion.

5. A merchandise display assembly comprising:

a support member;

a hook projecting from the support member for slidably suspending associated merchandise items, said hook including a back end which is mounted in said support member and a front end having a retainer member for preventing the merchandise items from sliding off said hook; and, a resilient one piece pusher for urging the merchandise items toward said hook front end, said pusher comprising:

a mounting portion by which said pusher is mounted on said back end of said hook, an elongated portion extending from said mounting portion, said elongated portion including a first aperture, a second aperture, spaced from said first aperture, and a first slit extending from said first aperture to said second aperture, said first slit allowing said elongated Portion to be mounted on said hook so that said first and second apertures surround the hook at spaced locations, and a front face of said elongated portion, said front face contacting a rearmost one of the associated merchandise items, wherein said elongated portion further includes a third aperture, a fourth aperture and a second slit extending from said third aperture to said fourth aperture, said third and fourth apertures and second slit being spaced from said first and second apertures and said first slit along the length of said elongated portion, said second slit allowing said elongated portion to be mounted on said hook so that said third and fourth apertures surround the hook at spaced locations.

6. The display assembly of claim 5 wherein said elongated portion assumes an accordion-like shape on said hook when said first, second, third and fourth apertures surround said hook at spaced locations.

7. The display assembly of claim 1 wherein said mounting portion of said pusher comprises:

a first section;

a second section;

a fold line at which said first section can be folded to overlie said second section;

a first aperture located in said first section;

a second aperture located in said second section; and, a slit which extends between said first and second apertures to allow said mounting portion to be mounted on said back end of said hook.

8. The display assembly of claim 1 wherein said mounting portion of said pusher comprises a pair of spaced apertures and a reinforcing rib positioned between said pair of spaced apertures.

9. The display assembly of claim 1 wherein said elongated portion of said pusher comprises:

a third aperture extending through said elongated portion;

a fourth aperture extending through said elongated portion; and, a second slit extending from said third aperture to said fourth aperture, said third and fourth apertures and second slit being spaced from said first and second apertures and said first slit along the length of said elongated portion, said second slit allowing said elongated portion to be mounted on said hook so that said third and fourth apertures surround the hook at spaced locations.

10. A merchandise display assembly comprising:

a support member;

a hook protecting from the support member for slidably suspending associated merchandise items, said hook including a back end which is mounted in said support member and a front end having a retainer member for preventing the merchandise items from sliding off said hook; and, a resilient one piece pusher for urging the merchandise items toward said hook front end, said pusher comprising:

a mounting portion by which said pusher is mounted on said back end of said hook, an elongated portion extending from said mounting portion, said elongated portion including a first aperture, a second aperture, spaced from said first aperture, and a first slit extending from said first aperture to said second aperture, said first slit allowing said elongated portion to be mounted on said hook so that said first and second apertures surround the hook at spaced locations, and a front face of said elongated portion, said front face contacting a rearmost one of the associated merchandise items, wherein said elongated portion further comprises a third aperture and a second slit extending from said third aperture to said front face of said elongated portion to allow said front face to be mounted on said hook until said third aperture surrounds said hook.

11. A one piece pusher for urging merchandise items toward a front end of a merchandise display hook, said pusher comprising:

a mounting portion by which the pusher is mounted on a back end of an associated hook;

an elongated portion extending from said mounting portion, said elongated portion including a first aperture, a second aperture, spaced from said first aperture, and a first slit extending from said first aperture to said second aperture, said first slit allowing said elongated portion to be mounted on the associated hook so that said first and second apertures surround the associated hook at spaced locations;

a front face of said elongated portion, said front face contacting a rearmost one of the associated merchandise items to urge it forwardly towards a front end of the associated hook; and, a display portion for displaying merchandising information, said display portion being visible when associated merchandise items are mounted on said hook, said display portion being connected to said elongated portion.

12. The pusher of claim 11 wherein said display portion extends from said front face of said elongated portion.

13. The pusher of claim 11 wherein said elongated portion comprises a first section and a second section and wherein said display portion extends from said second section of said elongated portion and wherein said elongated portion second section is disposed in parallel relationship to said elongated portion first section.

14. A one piece pusher for urging merchandise items toward a front end of a merchandise display hook, said pusher comprising:

a mounting portion by which the pusher is mounted on a back end of an associated hook;

an elongated portion extending from said mounting portion, said elongated portion including a first aperture, a second aperture, spaced from said first aperture, and a first slit extending from said first aperture to said second aperture, said first slit allowing said elongated portion to be mounted on the associated hook so that said first and second apertures surround the associated hook at spaced locations;

a front face of said elongated portion, said front face contacting a rearmost one of the associated merchandise items to urge it forwardly towards a front end of the associated hook, wherein said elongated portion further includes a third aperture, a fourth aperture and a second slit extending from said third aperture to said fourth aperture, said third and fourth apertures and second slit being spaced from said first and second apertures and said first slit along the length of said elongated portion, said second slit allowing said elongated portion to be mounted on said hook so that said third and fourth apertures surround the hook at spaced locations.

15. The pusher of claim 14 wherein said elongated portion assumes an accordion-like shape on the associated hook when said first, second, third and fourth apertures surround the associated hook at spaced locations.

16. The pusher of claim 11 wherein said mounting portion comprises a pair of spaced apertures and a reenforcing rib positioned between said pair of apertures.

17. The pusher of claim 11 wherein said mounting portion comprises:

a first section;

a second section; and, a fold line at which said first section can be folded to overlie said second section.

18. The pusher of claim 17 wherein said mounting portion further comprises:

a first aperture located in said first section;

a second aperture located in said second section; and, a slit which extends between said first and second apertures to allow said mounting portion to be mounted on the rear end of the hook.

19. The pusher of claim 11 wherein said mounting portion comprises:

a third aperture located in said elongated portion;

a fourth aperture located in said elongated portion and spaced from said third aperture; and, a second slit extending between said third and fourth apertures, said third and fourth apertures and second slit being spaced from said first and second apertures and said first slit along the length of said elongated portion, said second slit allowing said elongated portion to be mounted on said hook so that said third and fourth apertures surround the hook at spaced locations.

20. An elongated one piece pusher made from a resilient material for urging merchandise items toward a front end of a merchandise display hook, said pusher comprising:

a mounting portion by which the pusher is mounted on an associated hook;

an elongated portion extending from said mounting portion, said elongated portion including a first section and a second section, said first section comprising a first aperture, a second aperture, spaced from said first aperture, and a first slit extending from said first aperture to said second aperture, said first slit allowing said elongated portion to be mounted on the associated hook so that said first and second apertures surround the associated hook at spaced locations, said elongated portion assuming an accordion-like shape on the associated hook; and, a display portion for displaying merchandising information, said display portion being connected to said elongated portion second section and extending above a plane of the associated hook.

21. The pusher of claim 20 wherein said mounting portion comprises a third aperture, a fourth aperture spaced from said third aperture and a second slit extending from said third aperture to said fourth aperture, said second slit allowing said mounting portion to be mounted on the back end of the associated hook so that said third and fourth apertures surround the associated hook.

22. The pusher of claim 21 wherein said elongated portion second section is disposed in parallel relationship to said elongated portion first section.

23. An elongated one piece pusher made from a resilient material for urging merchandise items toward a front end of a merchandise display hook, said pusher comprising:

a mounting portion by which the pusher is mounted on an associated hook;

an elongated portion extending from said mounting portion, said elongated portion including a first section and a second section, said first section comprising a first aperture, a second aperture, spaced from said first aperture, and a first slit extending from said first aperture to said second aperture, said first slit allowing said elongated portion to be mounted on the associated hook so that said first and second apertures surround the associated hook at spaced locations, said elongated portion assuming an accordion-like shape on the associated hook; and, a display portion for displaying merchandising information, said display portion being connected to said elongated portion second section, wherein said elongated portion second section comprises a frame-like structure enclosing said elongated portion first section on three sides.

24. The pusher of claim 23 wherein said elongated portion first section is delineated from said elongated portion second section by a cut line.

25. The pusher of claim 23 wherein said elongated portion first section is delineated from said elongated portion second section by a perforation line.

* * * * *